US009222643B2

(12) United States Patent
Zhang et al.

(10) Patent No.: US 9,222,643 B2
(45) Date of Patent: Dec. 29, 2015

(54) LED ILLUMINATING DEVICE FOR STAGE LIGHTING AND METHOD FOR IMPROVING COLOR UNIFORMITY OF THE DEVICE

(75) Inventors: Quan Zhang, Shenzhen (CN); Yi Li, Shenzhen (CN)

(73) Assignee: APPOTRONICS LTD., Shenzhen (CN)

( * ) Notice: Subject to any disclaimer, the term of this patent is extended or adjusted under 35 U.S.C. 154(b) by 911 days.

(21) Appl. No.: 13/388,057

(22) PCT Filed: Jul. 30, 2010

(86) PCT No.: PCT/CN2010/001162

§ 371 (c)(1), (2), (4) Date: Jan. 30, 2012

(87) PCT Pub. No.: WO2011/011981

PCT Pub. Date: Feb. 3, 2011

(65) Prior Publication Data

US 2012/0153852 A1 Jun. 21, 2012

(30) Foreign Application Priority Data

Jul. 31, 2009 (CN) ..... 2009 1 0109505

(51) Int. Cl.
*H05B 37/00* (2006.01)
*F21V 5/00* (2015.01)
(Continued)

(52) U.S. Cl.
CPC . *F21V 5/008* (2013.01); *F21V 5/04* (2013.01); *F21V 7/0008* (2013.01); *F21W 2131/406* (2013.01); *F21Y 2101/02* (2013.01); *F21Y 2103/003* (2013.01); *F21Y 2113/005* (2013.01)

(58) Field of Classification Search
USPC ..... 315/192, 312, 291; 362/231, 237, 244, 362/245, 293, 239, 800, 235; 353/33, 96, 353/31, 37, 87, 32, 52, 56, 69, 81, 122
See application file for complete search history.

(56) References Cited

U.S. PATENT DOCUMENTS 5,001,609 A * 3/1991 Gardner et al. ..... 362/555
2004/0189956 A1 9/2004 Kanayama et al.
(Continued)

FOREIGN PATENT DOCUMENTS

CN 1517783 8/2004
CN 1554982 12/2004
(Continued)

OTHER PUBLICATIONS

Chinese Office Action, dated Mar. 7, 2012, in a counterpart Chinese patent application No. CN 200910109505.0.
(Continued)

*Primary Examiner* — Lincoln Donovan
*Assistant Examiner* — Thomas Skibinski
(74) *Attorney, Agent, or Firm* — Chen Yoshimura LLP

(57) ABSTRACT

A LED illumination device for stage lighting includes LED arrays (110) packaged on a heat dissipating substrate and including a plurality of LED chips (111), a light combining device (200) for combining the light emitted by respective LED arrays (110), and a focusing lens (400) for focusing the combined light to a light output port. The illumination device further includes a fly-eye lens pair (300) disposed between the light combining device (200) and the focusing lens (400). The fly-eye lens pair (300) comprises two fly-eye lenses, each being formed of a plurality of lens units (310) tightly connected together and having the same lens surface curvature. A method for improving color uniformity of the device is also provided.

11 Claims, 7 Drawing Sheets

(51) Int. Cl.

| | |
|---|---|
| ***F21V 5/04*** | (2006.01) |
| ***F21V 7/00*** | (2006.01) |
| *F21W 131/406* | (2006.01) |
| *F21Y 101/02* | (2006.01) |
| *F21Y 103/00* | (2006.01) |
| *F21Y 113/00* | (2006.01) |

(56) References Cited

U.S. PATENT DOCUMENTS

| | | | | |
|---|---|---|---|---|
| 2006/0023449 | A1* | 2/2006 | Lee et al. | 362/231 |
| 2007/0253197 | A1* | 11/2007 | Kung et al. | 362/231 |
| 2008/0030707 | A1* | 2/2008 | Tanaka et al. | 355/67 |
| 2008/0191626 | A1* | 8/2008 | Salter et al. | 315/77 |
| 2008/0212173 | A1 | 9/2008 | Mizusawa | |
| 2008/0237620 | A1* | 10/2008 | Shiue et al. | 257/98 |
| 2008/0302974 | A1* | 12/2008 | Wang et al. | 250/442.11 |
| 2010/0165300 | A1 | 7/2010 | Shimaoka et al. | |

FOREIGN PATENT DOCUMENTS

| | | |
|---|---|---|
| CN | 101042225 | 9/2007 |
| CN | 101093066 | 12/2007 |
| CN | 101107572 | 1/2008 |
| CN | 201137834 | 10/2008 |
| CN | 101371070 | 2/2009 |
| CN | 201487708 | 5/2010 |

OTHER PUBLICATIONS

International Search Report in the parent PCT application No. PCT/CN2010/001162, dated Nov. 11, 2010.
IPRP in the parent PCT application No. PCT/CN2010/001162, dated Nov. 11, 2010.

* cited by examiner

LED ILLUMINATING DEVICE FOR STAGE LIGHTING AND METHOD FOR IMPROVING COLOR UNIFORMITY OF THE DEVICE

This is a National Stage application of PCT/CN2010/001162, filed Jul. 30, 2010, which claims priority from China application CN 200910109505.0, filed Jul. 31, 2009.

BACKGROUND OF THE INVENTION

1. Field of the Invention

This invention relates to illumination devices and systems as well as related functions and components, and in particular, it relates to illumination devices and systems useful in stage lighting.

2. Description of the Related Art

Current high power stage lights use metal halide discharge lamps as the light source. Because such lamps are white light sources, color lights of various colors are obtained by using color filters in front of the metal halide discharge lamps. Metal halide discharge lamps have relatively short life, typically from a few hundred to a few thousand hours. When color filters are used to obtain light of various colors for stage lighting, the color lights have relatively low color saturation, and their colors are neither very vivid nor very rich. LED (light emitting diodes) light sources are clean and energy efficient light sources and have long life. With the achievable luminous flux of LED light sources increasing every year, LED light sources are becoming more widely adopted as illumination devices. As LEDs can emit monochromatic lights of various colors, using LED light sources for stage lighting can achieve color lights without using filters. Further, by adjusting the drive current of LEDs of various base colors such as primary colors red, green and blue, desired colors of the output light can be achieved. The relatively high saturation of monochromatic LED light sources offers more freedom in generating desired color lights for stage lighting systems.

Current LED light sources tend to generate a large amount of heat which limits the output power of individual LED chips, and their light emitting efficiency is still relatively low. Thus, high power stage lighting systems use LED arrays to achieve the desired luminous flux.

Chinese patent application No. 200720061982.0 describes a light source system for stage lighting, which employs a LED array and a large heat dissipation device to provide a power of 100 W. This system can also achieve adjustable color by controlling the power of the LEDs of different colors in the LED array. However, due to concerns on heat dissipation and luminous flux, as well as uniformity of brightness and color of the output light, this system still cannot satisfy the need for high power stage lighting systems.

To overcome the problems of the above system, an improved system is described in a Chinese patent application filed by the applicant of this application. This system employs a wavelength-based light combining device to combine monochromatic lights from multiple LED arrays into one light beam. This system offers increased output power and improved uniformity of brightness and color of the output light.

The above systems have certain shortcomings.

1. The individual LED chips in the LED array have different emission spectra, brightness and temperature characteristics. When the light from the multiple LED chips are combined by downstream optical elements and projected on a stage or on a screen, various parts of the stage or screen corresponding to the different LED chips may have different brightness and color spectrum, causing the local color cast in the projected image.

2. The light combining device used in the above systems does not provide ideal light combining result in combining the multiple monochromatic lights, so that the projected image on the stage or screen has inferior color uniformity, in particular when white color is output.

SUMMARY OF THE INVENTION

Accordingly, the present invention is directed to a stage lighting system and related methods that substantially obviate one or more of the problems due to limitations and disadvantages of the related art. An object of the present invention is to reduce the color non-uniformity in stage lighting methods and systems that use LED light sources, and to reduce the color cast problem caused by such non-uniformity.

To achieve these and other advantages and in accordance with the purpose of the present invention, as embodied and broadly described, the present invention provides a method for improving color uniformity of an LED (light emitting diode)-based stage lighting system, the LED-based stage lighting system including an LED arrays having a plurality of LED chips emitting different color lights packaged on a heat dissipating substrate, the method including:

A. combining light from the plurality of LED chips into one combined light beam;

B. directing the combined light beam via a focusing lens to a light output port of the stage lighting system; and C. controlling light emission of the plurality of LED chips of different colors in the LED arrays to obtain an output light at the light output port having predefined colors or color variation.

In step B, the combined light beam is directed to pass through a fly-eye lens pair to illuminate on the focusing lens; wherein the fly-eye lens pair includes two fly-eye lenses facing each other, each fly-eye lens being formed of a plurality of lens units that have a same lens surface curvature and are tightly jointed to each other, and wherein a rear fly-eye lens of the fly-eye lens pair is disposed along the optical path on a focal plane of a front fly-eye lens of the fly-eye lens pair.

In step B, each lens unit has a shape of an equal-sided hexagon or a square in a front cross-sectional view, and the lens units are joined together without any gap between them. Or, each lens unit has a circular shape in the front cross-sectional view, and the lens units are joined together with their edges tangentially contacting each other.

The above method may further include providing a pattern plate carrying a pattern, wherein the pattern is disposed at the light output port of the stage lighting system to generate a patterned projected light spot.

In another aspect, the present invention provides an LED (light emitting diode)-based stage lighting system which includes: an LED arrays having a plurality of LED chips emitting different color lights packaged on a heat dissipating substrate; a light combining system for combining light from the plurality of LED chips into one combined light beam; a focusing lens for receiving the combined light beam and focusing it on a light output port of the stage lighting system; and a fly-eye lens pair disposed between the focusing lens and the light combining system, wherein the fly-eye lens pair includes two fly-eye lenses facing each other, each fly-eye lens being formed of a plurality of lens units that have a same lens surface curvature and are tightly jointed to each other, and wherein a rear fly-eye lens of the fly-eye lens pair is disposed along the optical path on a focal plane of a front fly-eye lens of the fly-eye lens pair.

To increase light utilization, in the stage lighting system, each lens unit has a shape of an equal-sided hexagon or a square in a front cross-sectional view, and the lens units are joined together without any gap between them; or, each lens unit has a circular shape in the front cross-sectional view, and the lens units are joined together with their edges tangentially contacting each other. The fly-eye lens pair may be formed of glass, or formed of plastic with coatings. Preferably, the fly-eye lens pair is formed as an integral unit.

The stage lighting system may include three LED arrays, each LED array including a plurality of LED chips emitting a same color light, wherein the light combining device includes a wavelength-based light combining device having three light input ports and three lens arrays corresponding to the three LED arrays, each lens array including a plurality of lenses, each lens in the lens arrays being aligned with one LED chip to collimate light emitted by the LED chip into near parallel light, wherein three near parallel light beams from the three lens arrays are combined by the wavelength-based light combining device into the combined light beam toward the focusing lens.

The wavelength-based light combining device may be an X-shaped wavelength-based light combining device having two dichroic filters disposed perpendicular to each other, defining three light input ports and a light output port.

The wavelength-based light combining device may also be a cascade type wavelength-based light combining device including two dichroic filters disposed in parallel with each other, wherein each dichroic filter defines a first input port and a second input port for illuminating two sides of the dichroic filter, and an output port on a reflecting side of the dichroic filter, wherein along the direction of the light beam, the output port of a first one of the two dichroic filters faces the first input port of a second one of the dichroic filters. The dichroic filters may be dichroic filter plates or transparent plates coated with dichroic filter films.

The stage lighting system may further include a pattern plate carrying a pattern, wherein the pattern is disposed at the light output port of the stage lighting system.

Compared to existing stage lighting systems, the stage lighting system according to embodiments of the present invention has the following advantages.

The fly-eye lens performs a division and integration for the initially combined light beam, leading to increase uniformity of the combined light beam. As a result, the brightness and the color uniformity of the projected light spot on the stage or screen are increased, and the problem of color cast in existing stage lighting system is solved or greatly reduced. Meanwhile, the system design takes into consideration the best match of the shape of the light spot generated by the optical system and the circular shape of the pattern to be illuminated, and uses an equal-sided hexagonal shape for the lens units of the fly-eye lens pair to optimize light utilization efficiency.

DETAILED DESCRIPTION OF THE PREFERRED EMBODIMENTS

Embodiments of the present invention are described below with references to the drawings.

The present invention is directed to a method and apparatus for improving the color uniformity of a LED-based stage lighting system. The LED-based stage lighting system according to embodiments of the present invention includes an LED array 110 having a plurality of LED chips packaged on a heat dissipating substrate. The system may use one LED array having multiple LED chips emitting at two or more wavelengths, or two or more LED arrays having LED chips emitting at different wavelengths. The LED chips include but are not limited to LED chips emitting red, green and blue color lights, depending on the base color desired of the optical system. A method according to an embodiment of the present invention includes:

A. Combining the light from the multiple LED chips into one combined light beam. In one example, the illumination system includes three LED arrays, each LED array having the same color LED chips. Three lens arrays each including multiple lenses are employed, each lens being aligned with one LED chip to collimate the light from the LED chip into a near parallel light. The three near parallel lights from the three lens arrays are combined into one light beam by a wavelength-based light combining device.

B. Directing the combined light beam via a focusing lens to a light output port.

C. Controlling light emission of the LED chips of different colors in the LED arrays to obtain output light at the light output port having desired color or color variation.

In step B above, the combined light beam passes through a fly-eye lens pair to illuminate on the focusing lens. The fly-eye lens pair includes two fly-eye lenses facing each other. Each fly-eye lens is formed of multiple lens units that have the same lens surface curvature and are tightly jointed to each other. Along the optical path, the rear fly-eye lens is disposed on the focal plane of the front fly-eye lens.

To obtain a projected image on a stage or screen having a desired pattern, the method further includes the following step:

Providing a pattern plate carrying patterns, where the pattern is disposed at the light output port to generate a patterned effect of the projected light spot on the stage.

To increase utilization of the LED light energy, in step B, each lens unit of the fly-eye lens has the shape of an equal-sided hexagon (or square) in the front cross-sectional view, and the lens units are joined together without any gap between them. Or, each lens unit of the fly-eye lens has a circular shape in the front cross-sectional view, and the lens units are joined together with their edges tangentially contacting each other.

Figure 1:
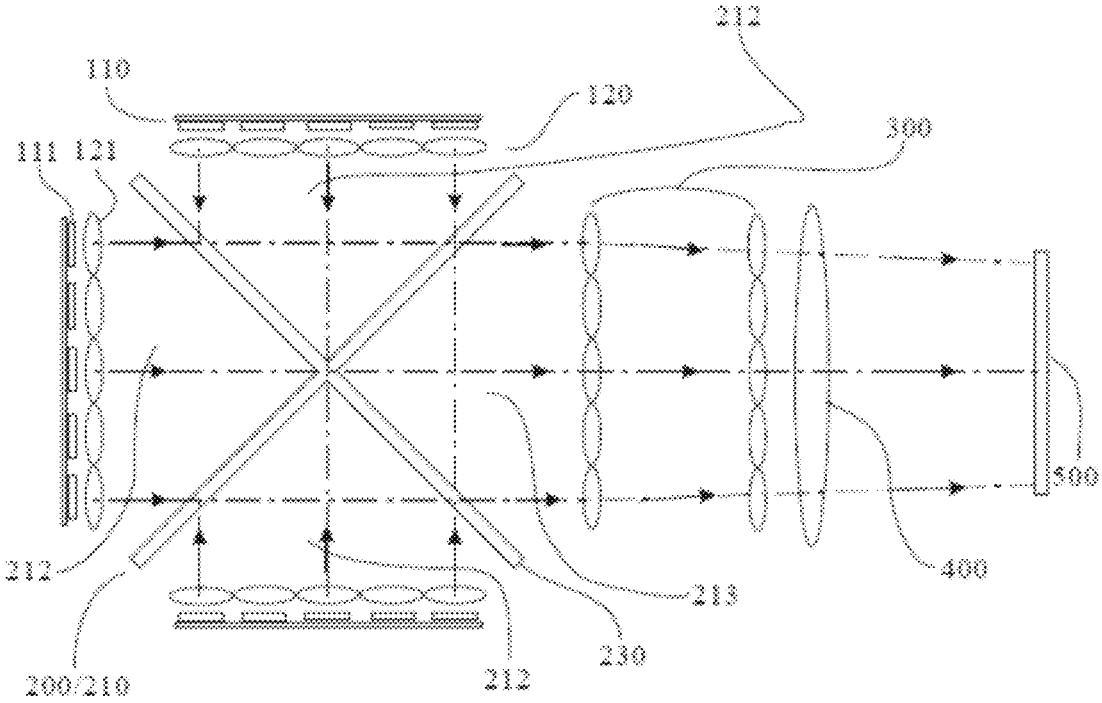
FIG. 1 schematically illustrates the optical arrangement of an illumination system according to a first embodiment of the present invention.
Figure 2:
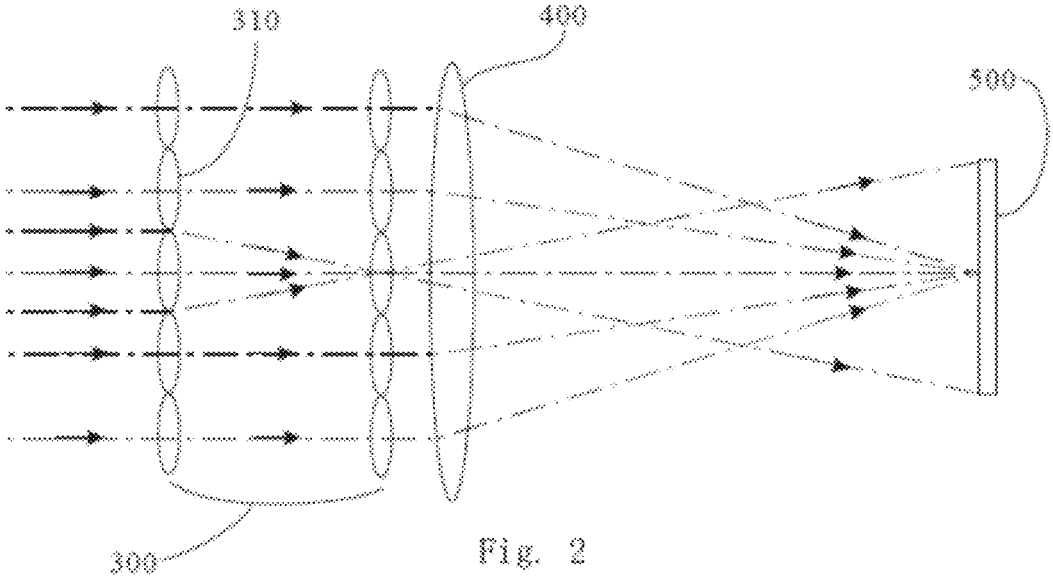
FIG. 2 schematically illustrates a fly-eye lens used in the first embodiment.

A stage lighting system according to an embodiment of the present invention includes an LED array having a plurality of LED chips packaged on a heat dissipating substrate, a light combining system to combine the lights from the multiple LEDs into one light beam, and a focusing lens to focus the combined light to a light output port of the system. In one example, the stage lighting system includes three LED arrays, as shown in FIG. 1, the three LED array having LED chips emitting (for example) red, green and blue lights, respectively. The light combining system includes three lens arrays 120 respectively aligned with the three LED arrays and a wavelength-based light combining device 200 having three light input ports. Each LED array 110 includes multiple LED chips 111 arranged in a regular array to form an arrayed light source. Each lens array 120 includes multiple lenses 121, each lens being aligned with an LED chip 111 to collimate the light from the LED chip into a near parallel light. The three near parallel light beams from the three lens arrays 120 are inputted into the wavelength-based light combining device 200 and combined into one light beam. The combined light beam is protected toward the focusing lens 400. In this embodiment, the LED based stage lighting system further includes a fly-eye lens pair 300 disposed between the light combining system and the focusing lens 400. The fly-eye lens pair 300 includes two fly-eye lenses facing each other. Each fly-eye lens is formed of multiple lens units that have the same lens surface curvature and are tightly jointed to each other. Along the optical path, the rear fly-eye lens is disposed on the focal plane of the front fly-eye lens.

To obtain a projected light spot on a stage or screen having a desired pattern, the LED based stage lighting system further includes a pattern plate 500, where a pattern carried on the pattern plate is disposed at the light output port behind the focusing lens 400.

When the stage lighting system includes only one LED array 110, the light combining system in the above embodiment may be a light collecting assembly having a cup-shaped reflector. The LED array 110 is disposed near the bottom of the cup-shaped reflector, and the opening of the cup-shaped reflector faces the focusing lens 400.

When the stage lighting system includes two LED arrays 110, each LED array having LED chips of the same color, the light combining system in the above embodiment may include a dichroic filter and two lens arrays 120 corresponding to the two LED arrays. The two near parallel light beams generated by the two lens arrays illuminate the two sides of the dichroic filter, respectively, and are transmitted and reflected by the dichroic filter, respectively, into one beam toward the focusing lens 400.

Figure 7:
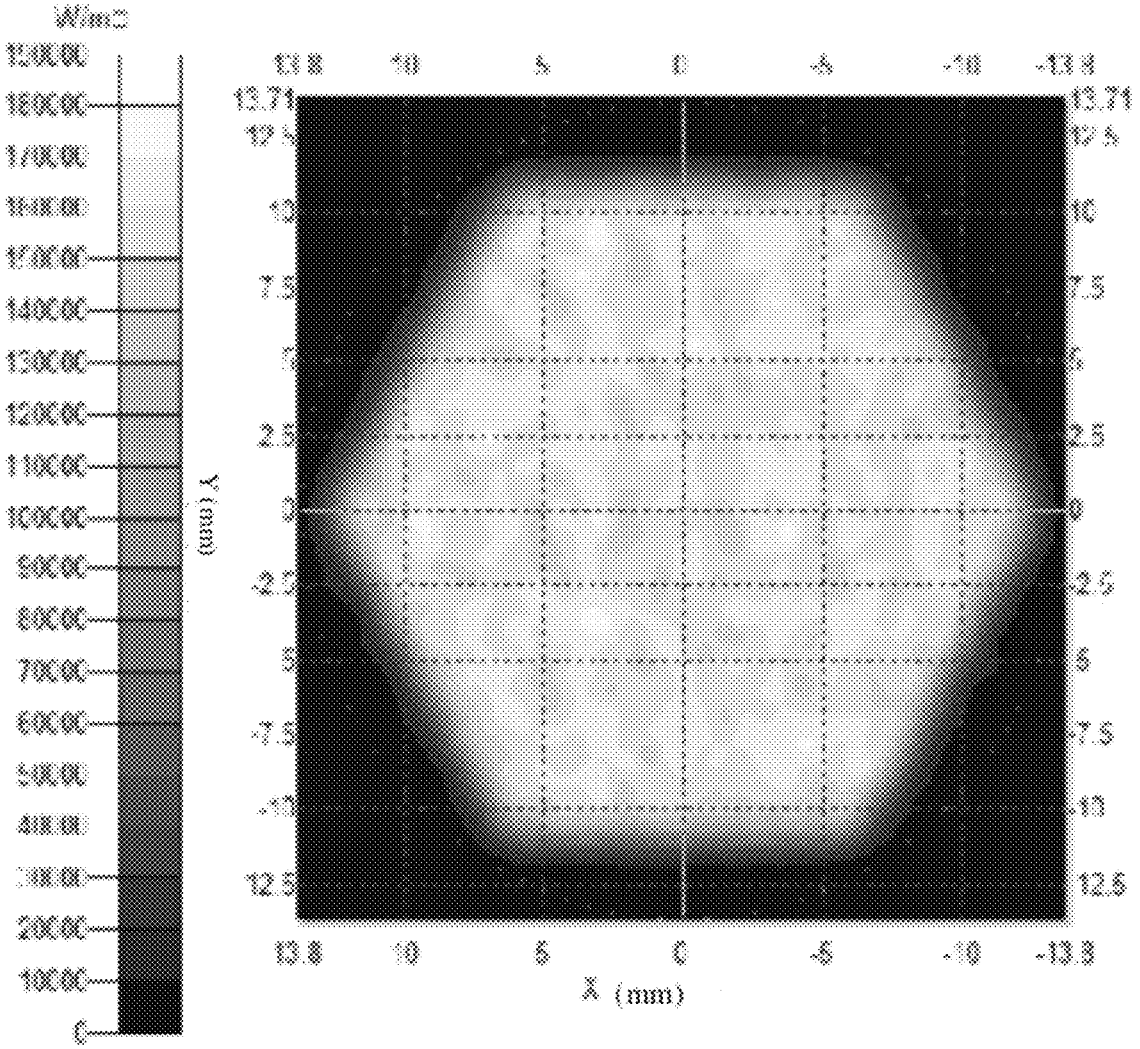
FIG. 7 illustrates a projected light spot produced by the first embodiment.
Figure 8:
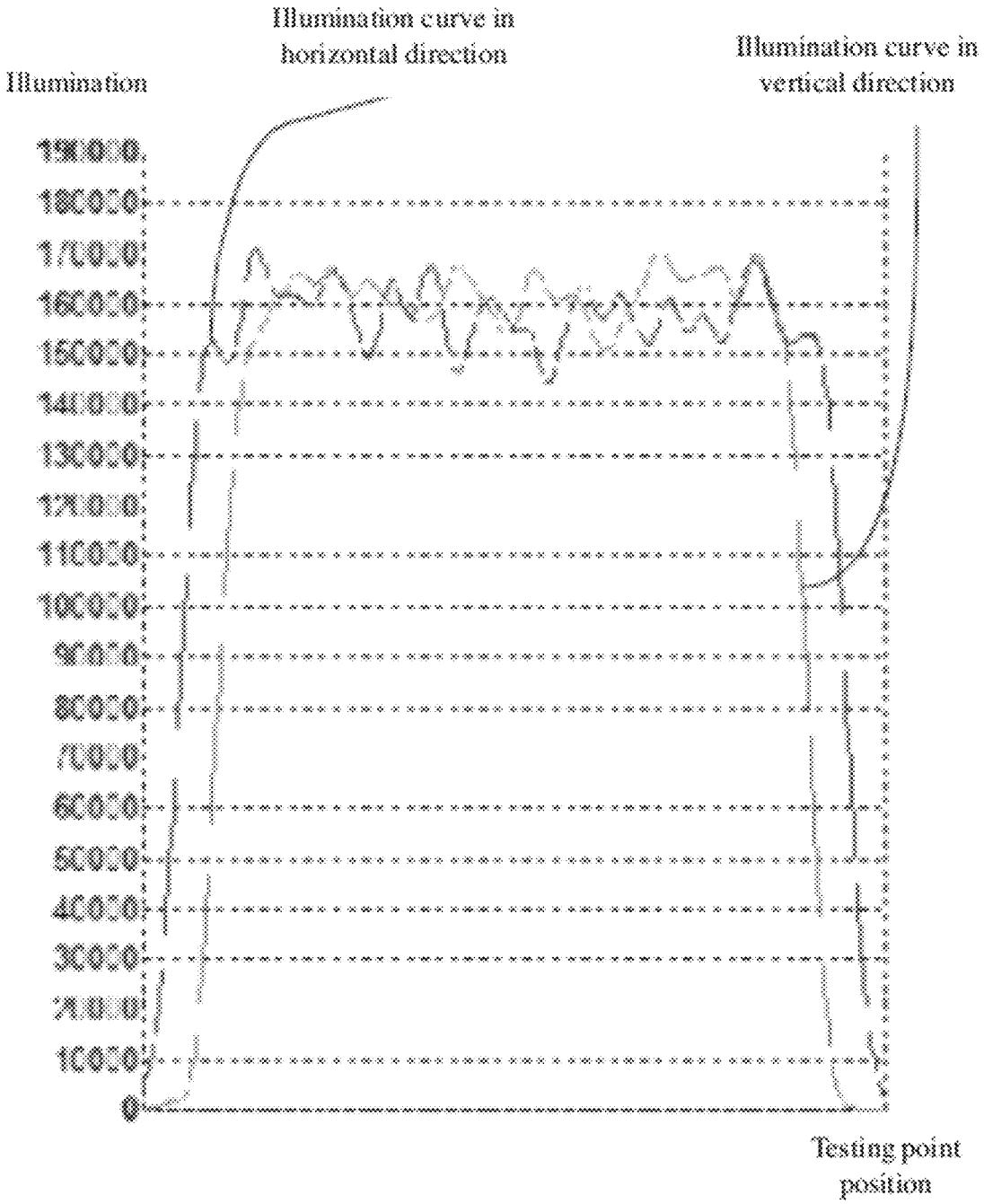
FIG. 8 illustrates the illumination curves of the projected light spot shown in FIG. 7.

In embodiments of the present invention, the LED chips 111 of the LED arrays 110 are square shaped light sources emitting light in a 180 degree range. The lens arrays 120 collimate the light from the LED chips 111 into near parallel light. Along the optical path between the wavelength-based light combining device 200 and focusing lens 400, the front fly-eye lens 300 focuses the combined parallel light beam from the wavelength-based light combining device 200 onto the surface of the rear fly-eye lens 300. The lens units 310 of the front fly-eye lens 300 divide and integrate the light intensity illuminated on the surface of the front fly-eye lens. The lens units 310 of the front fly-eye lens are imaged by the rear fly-eye lens 300 and the focusing lens 400 onto the pattern plate 500, the light intensity from each of the multiple lens unit 310 is integrated on the pattern plate 500; in other words, each lens units 310 of the front fly-eye lens is imaged on the pattern plate 500, resulting in superior brightness uniformity and color uniformity of the projected light spot on the pattern plate 500. FIGS. 7 and 8 illustrate experimental data of the projected light spot and its optical properties obtained by the first embodiment. It can be seen that the optical properties (illumination) of the projected light spot is very uniform. Thus, the stage lighting system according to this embodiment of the present invention solves the color cast problem of conventional systems and improves the color uniformity of the output light.

Figure 3:
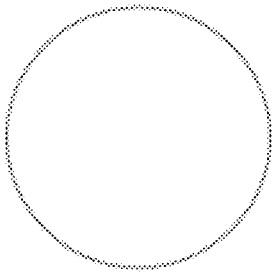
FIG. 3 is a front view of a pattern of a pattern plate useful in the first embodiment.
Figure 4:
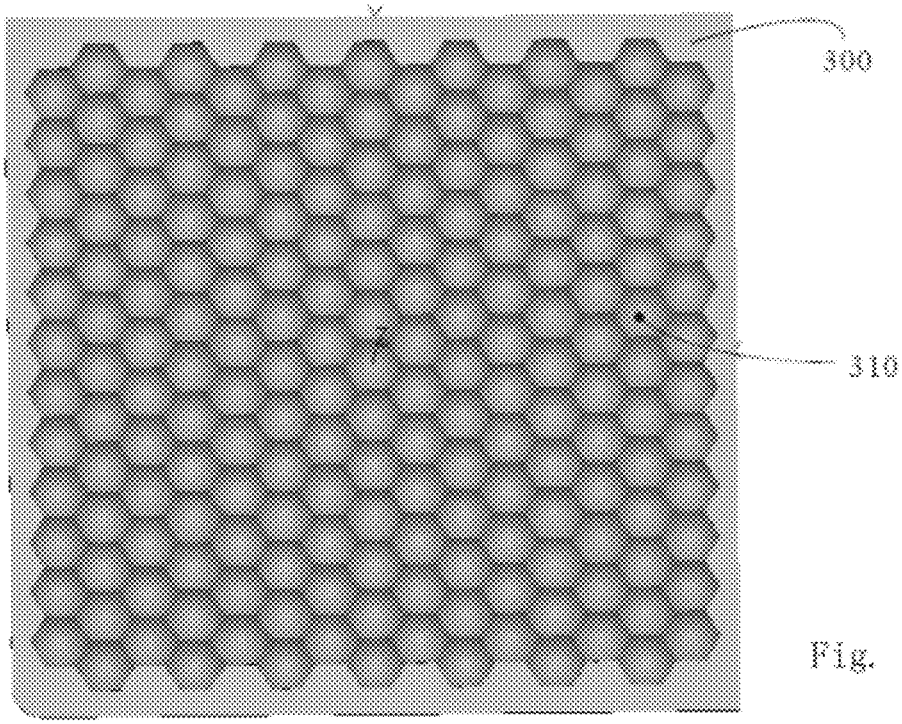
FIG. 4 is a front view of a first implementation of a fly-eye lens according to embodiments of the present invention.
Figure 5:
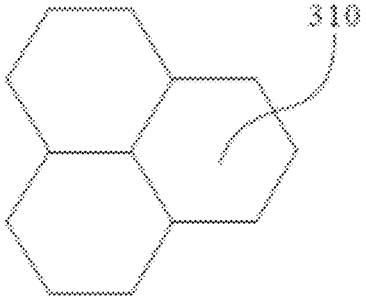
FIG. 5 is a partial front cross-sectional view of the fly-eye lens of FIG. 4.
Figure 6:
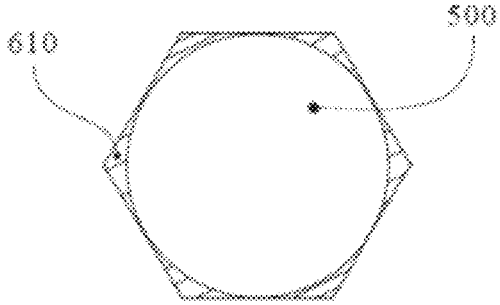
FIG. 6 schematically illustrates the light energy loss for the fly-eye lens shown in FIG. 4.
Figure 9:
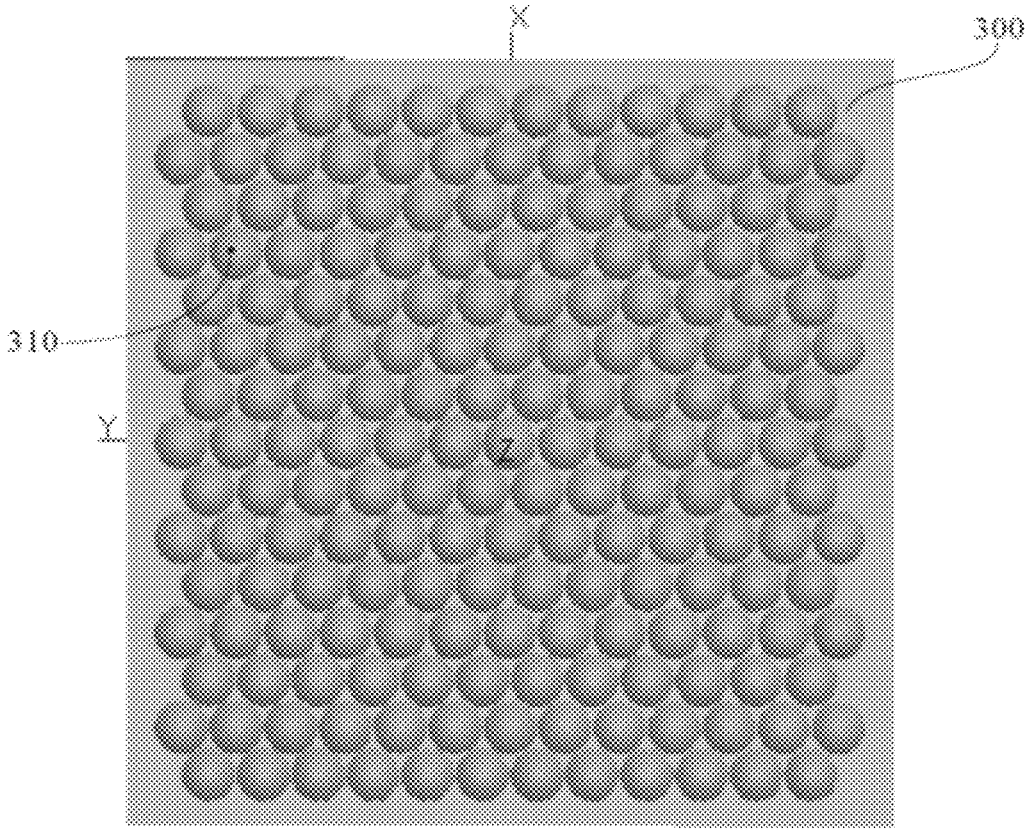
FIG. 9 is a front view of a second implementation of the fly-eye lens according to embodiments of the present invention.
Figure 10:
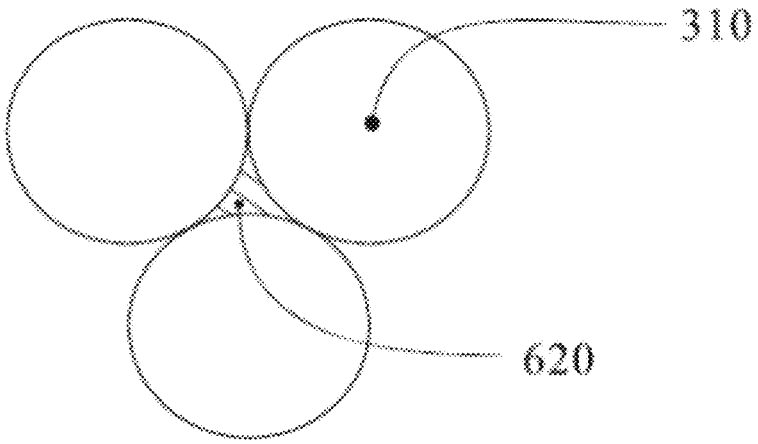
FIG. 10 is a partial front cross-sectional view of the fly-eye lens of FIG. 9.
Figure 11:
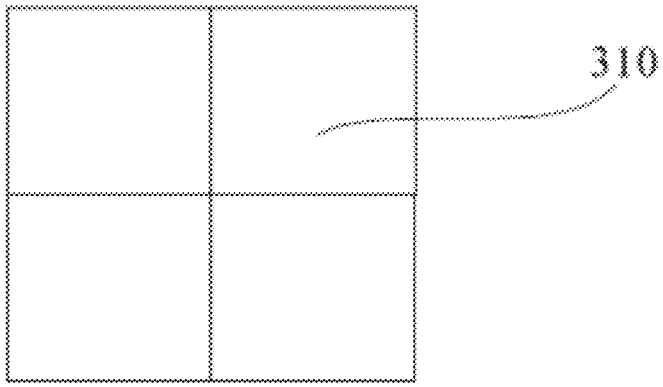
FIG. 11 is a partial front cross-sectional view of a third implementation of the fly-eye lens according to embodiments of the present invention.
Figure 12:
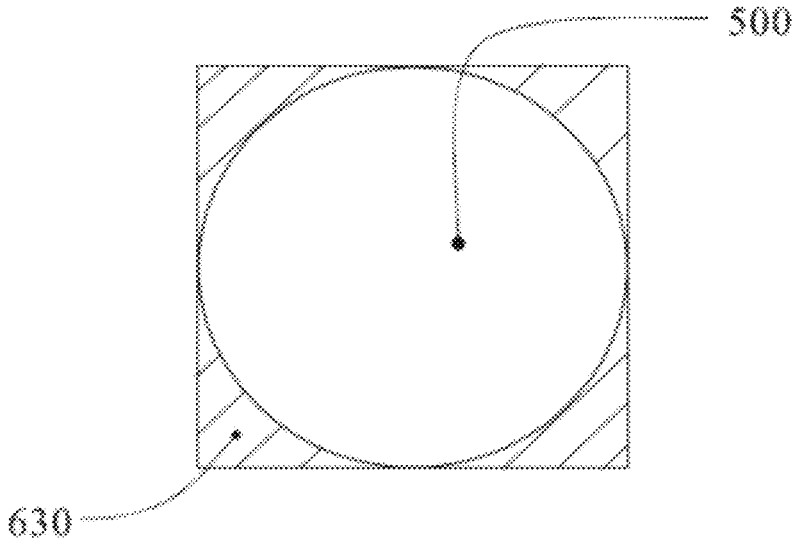
FIG. 12 schematically illustrates the light energy loss of the fly-eye lens of FIG. 11.

Preferably, the front cross-sectional shape of each lens unit 310 should match the shape of the pattern on the pattern plate 500 to increase light utilization efficiency. In stage lighting systems, the projected light spot is often required to be circular in shape. Thus, in the first embodiment and other embodiments of the present invention, the shape of the pattern on the pattern plate is typically circular as shown in FIG. 3. In such situations, the shape and spatial arrangement of the lens units 310 of the fly-eye lens 300 are the main factors that determine the light energy loss. To increase light utilization efficiency, the multiple lens units 310 are preferably joined to each other without any gap in between. To join the multiple lens units 310 without any gaps, the front cross-sectional shape of the lens units 310 typically are required to be equal-sided polygons. However, the projected light spot on the pattern plate produced by such fly-eye lenses will have the shape of an equal-sided polygon, and part of the light spot will not illuminate the circular shaped pattern, causing light energy loss. To maximize the light energy useful for the shape of the pattern of the pattern plate, the projected light spot should be circular in shape, i.e., the lens units 310 should have a circular shaped front cross-section. However, such shaped lens units cannot be joined together without gaps; they can at best be joined such that they are in contact with each other tangentially. Thus, not all light illuminating on the fly-eye lens surface can pass through the lens units 310, causing light energy loss. In a first implementation of the fly-eye lens, shown in FIGS. 4 and 5, the front cross-sectional shape of the lens units 310 is an equal-sided hexagon, with the lens units joined together without gaps. As shown in FIG. 6, the shaded part 610 represents the part of the light spot projected on the pattern of the pattern plate 500 where light energy is lost. In a second implementation of the lens unit 310, as shown in FIGS. 9 and 10, the front cross-sectional shape of the lens units 310 is a circle, and the lens units 310 are joined together with their edges contacting each other tangentially. Here, while the projected light spot matches the shape of the circular pattern of the pattern plate 500, the light illuminating on the shaded area 620 of the fly-eye lens 300 cannot be projected onto the pattern plate. Thus, the shaded area 620 represents the part of the light energy that is lost. In a third implementation of the lens unit 310, as shown in FIG. 11, the front cross-sectional shape of the lens units 310 is a square, and the lens units 310 are joined together without gaps. The shaded area 630 shown in FIG. 12 represents the part of the light spot projected on the pattern of the pattern plate 500 where light energy is lost. From FIGS. 6, 10 and 12, it can be seen that for the same circular shaped pattern, the light energy loss is the smallest in the first implementation and largest in the third implementation.

The fly-eye lens 300 may be formed of glass, or formed of plastic with appropriate coating processes. To reduce cost and to make it easy to assemble, the fly-eye lens pair is preferably formed as one integral unit, where the two surfaces facing the optical path in two directions have a wave-like shape.

When the stage lighting system includes three or more LED arrays 110, the wavelength-based light combining device 200 may be accomplished by the following two ways.

As shown in FIG. 1, the light combining device 200 is an X-shaped wavelength-based light combining device 210, or a dichroic prism. The X-shaped wavelength-based light combining device 210 includes two dichroic filters 230 disposed perpendicular to each other, which form three light input ports 212 and a light output port 213. The dichroic filters 230 may be dichroic filter plates, or transparent plates coated with dichroic filter films.

Figure 13:
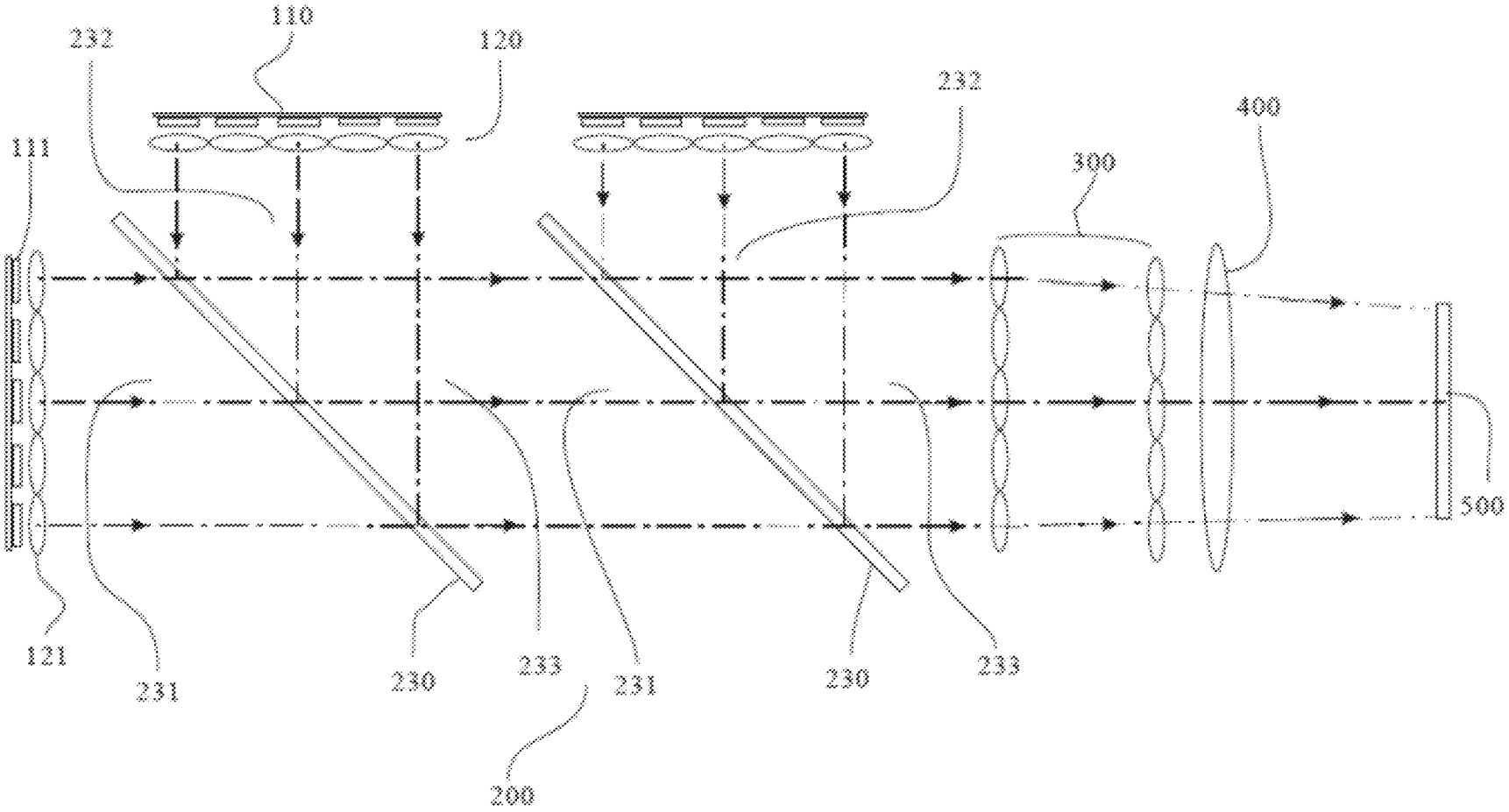
FIG. 13 schematically illustrates an illumination system according to second embodiment of the present invention.

As shown in FIG. 13, a second embodiment of the present invention includes three LED arrays, and the wavelength-based light combining device 200 is a cascade type wavelength-based light combining device including two dichroic filters 230 disposed in parallel to each other. Each dichroic filter 230 includes a first input port 231 and a second input port 232 for input light to illuminate two sides of the dichroic filter, and an output port 233 on the reflecting side of the dichroic filter. Along the direction of the light beam, the output port 233 of the first dichroic filter 230 faces the first input port 231 of the second dichroic filter 230. Thus, the light beams from the three LED arrays 110 are respectively inputted to the first and second input port 231 and 232 of the first dichroic filter 230 and the second input port 232 of the second dichroic filter 230, and the combined light is outputted from the output port 233 of the second dichroic filter 230. The dichroic filters 230 may be dichroic filter plates, or transparent plates coated with dichroic filter films.

It will be apparent to those skilled in the art that various modification and variations can be made in the stage lighting system and related method of the present invention without departing from the spirit or scope of the invention. Thus, it is intended that the present invention cover modifications and variations that come within the scope of the appended claims and their equivalents.

What is claimed is:

1. A method for improving color uniformity of an LED (light emitting diode)-based stage lighting system, the LED-based stage lighting system including an LED arrays having a plurality of LED chips emitting different color lights packaged on a heat dissipating substrate, the method comprising:

A. combining light from the plurality of LED chips into one combined light beam;

B. directing the combined light beam via a focusing lens to a light output port of the stage lighting system; and C. controlling light emission of the plurality of LED chips of different colors in the LED arrays to obtain an output light at the light output port having predefined colors or color variation;

wherein in step B, the combined light beam is directed to pass through a fly-eye lens pair to illuminate on the focusing lens;

wherein the fly-eye lens pair includes two fly-eye lenses facing each other, each fly-eye lens being formed of a plurality of lens units that have a same lens surface curvature and are tightly jointed to each other, wherein a rear fly-eye lens of the fly-eye lens pair is disposed along an optical path on a focal plane of a front fly-eye lens of the fly-eye lens pair, wherein the fly-eye lens pair is formed as one integral unit, and wherein two surfaces of the fly-eye lens pair facing optical path in two directions have a wavelike shape.

2. The method of claim 1, wherein the stage lighting system includes three LED arrays, each LED array having a plurality of LED chips emitting same color light, wherein step A includes:

providing three lens arrays each including a plurality of lenses, each lens being aligned with one LED chip to collimate light from the LED chip into a near parallel light; and combining the three near parallel lights from the three lens arrays into the combined light beam using a wavelength-based light combining device.

3. The method of claim 1, wherein in step B, each lens unit has a shape of an equal-sided hexagon or a square in a front cross-sectional view, and wherein the lens units are joined together without any gap between them, or each lens unit has a circular shape in the front cross-sectional view, and the lens units are joined together with their edges tangentially contacting each other.

4. The method of claim 1, further comprising providing a pattern plate carrying a pattern, wherein the pattern is disposed at the light output port of the stage lighting system to generate a patterned projected light spot.

5. An LED (light emitting diode)-based stage lighting system comprising:

an LED arrays having a plurality of LED chips emitting different color lights packaged on a heat dissipating substrate;

a light combining system for combining light from the plurality of LED chips into one combined light beam;

a focusing lens for receiving the combined light beam and focusing it on a light output port of the stage lighting system; and a fly-eye lens pair disposed between the focusing lens and the light combining system, wherein the fly-eye lens pair includes two fly-eye lenses facing each other, each fly-eye lens being formed of a plurality of lens units that have a same lens surface curvature and are tightly jointed to each other, wherein a rear fly-eye lens of the fly-eye lens pair is disposed along an optical path on a focal plane of a front fly-eye lens of the fly-eye lens pair, wherein the fly-eye lens pair is formed as one integral unit, and wherein two surfaces of the fly-eye lens pair facing optical path in two directions have a wavelike shape.

6. The stage lighting system of claim 5, wherein each lens unit has a shape of an equal-sided hexagon or a square in a front cross-sectional view, and wherein the lens units are joined together without any gap between them, or each lens unit has a circular shape in the front cross-sectional view, and the lens units are joined together with their edges tangentially contacting each other.

7. The stage lighting system of claim 5, comprising two LED arrays, each LED array including a plurality of LED chips emitting a same color light, wherein the light combining device includes a dichroic filter and two lens arrays corresponding to the two LED arrays, each lens array including a plurality of lenses, each lens in the lens arrays being aligned with one LED chip to collimate light emitted by the LED chip into near parallel light, wherein two near parallel light beams from the two lens arrays illuminate two sides of the dichroic filter, respectively, and are transmitted and reflected by the dichroic filter, respectively, into the combined light beam toward the focusing lens.

8. The stage lighting system of claim 5, comprising three LED arrays, each LED array including a plurality of LED chips emitting a same color light, wherein the light combining device includes a wavelength-based light combining device having three light input ports and three lens arrays corresponding to the three LED arrays, each lens array including a plurality of lenses, each lens in the lens arrays being aligned with one LED chip to collimate light emitted by the LED chip into near parallel light, wherein three near parallel light beams from the three lens arrays are combined by the wavelength-based light combining device into the combined light beam toward the focusing lens.

9. The stage lighting system of claim 8, wherein the wavelength-based light combining device is an X-shaped wavelength-based light combining device having two dichroic filters disposed perpendicular to each other, defining three light input ports and a light output port, and wherein the dichroic filters are dichroic filter plates or transparent plates coated with dichroic filter films;

or the wavelength-based light combining device is a cascade type wavelength-based light combining device including two dichroic filters disposed in parallel with each other, wherein each dichroic filter defines a first input port and a second input port for illuminating two sides of the dichroic filter, and an output port on a reflecting side of the dichroic filter, wherein along the direction of the light beam, the output port of a first one of the two dichroic filters faces the first input port of a second one of the dichroic filters, and wherein the dichroic filters are dichroic filter plates or transparent plates coated with dichroic filter films.

10. The stage lighting system of claim 5, further comprising a pattern plate carrying a pattern, wherein the pattern is disposed at the light output port of the stage lighting system.

11. The stage lighting system of claim 5, wherein the fly-eye lens pair is formed of glass, or formed of plastic with coatings.

* * * * *